US007530752B2

(12) United States Patent
Gueret

(10) Patent No.: US 7,530,752 B2
(45) Date of Patent: May 12, 2009

(54) APPLICATOR DEVICE FOR APPLYING A SUBSTANCE

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 473 days.

(21) Appl. No.: 11/135,317

(22) Filed: May 24, 2005

(65) Prior Publication Data

US 2005/0271454 A1 Dec. 8, 2005

Related U.S. Application Data

(60) Provisional application No. 60/577,169, filed on Jun. 7, 2004.

(30) Foreign Application Priority Data

May 25, 2004 (FR) ..... 04 51024

(51) Int. Cl.
*A46B 11/00* (2006.01)

(52) U.S. Cl. ..... 401/129; 401/122; 401/126

(58) Field of Classification Search ..... 401/121, 401/122, 126–130
See application file for complete search history.

(56) References Cited

U.S. PATENT DOCUMENTS 5,539,950 A 7/1996 Zar et al.
6,010,265 A * 1/2000 Bouix ..... 401/122
6,343,607 B1 2/2002 Gueret
6,412,496 B1 7/2002 Gueret
6,446,637 B2 9/2002 Gueret
6,539,950 B1 4/2003 Gueret
6,546,937 B2 4/2003 Gueret
6,581,610 B1 6/2003 Gueret
6,655,390 B2 12/2003 Gueret
6,662,810 B2 12/2003 Gueret
6,669,389 B2 * 12/2003 Gueret ..... 401/122
6,675,814 B2 1/2004 Gueret
6,814,084 B2 11/2004 Gueret
6,866,046 B2 3/2005 Gueret
6,866,437 B2 * 3/2005 Gueret ..... 401/130

(Continued)

FOREIGN PATENT DOCUMENTS

EP 1 129 640 A1 9/2001

(Continued)

OTHER PUBLICATIONS

French Search Report corresponding to French application No. FR 04 51024, dated Jan. 18, 2005, 3 pages.

(Continued)

*Primary Examiner*—David J Walczak
(74) *Attorney, Agent, or Firm*—Finnegan, Henderson, Farabow, Garrett & Dunner, LLP

(57) ABSTRACT

A device for applying a substance may comprise a receptacle configured to contain the substance, an applicator comprising an application member configured to be inserted into the receptacle so as to become loaded with the substance, and a magnetizable or magnetic wiper member disposed in such a manner so as to permit the application member to pass therethrough while the application member is being removed from the receptacle. The wiper member may be made of a material that is impermeable to the substance.

47 Claims, 2 Drawing Sheets

U.S. PATENT DOCUMENTS

| | | | |
|---|---|---|---|
| 2001/0033766 | A1 | 10/2001 | Gueret |
| 2001/0037815 | A1 | 11/2001 | Gueret |
| 2001/0047808 | A1 | 12/2001 | Gueret |
| 2002/0011251 | A1 | 1/2002 | Gueret |
| 2002/0124860 | A1 | 9/2002 | Gueret |
| 2002/0139385 | A1 | 10/2002 | Gueret |
| 2002/0182409 | A1 | 12/2002 | Gueret |
| 2003/0178043 | A1 | 9/2003 | Gueret |
| 2003/0213498 | A1 | 11/2003 | Gueret |
| 2004/0134507 | A1 | 7/2004 | Gueret |
| 2004/0161285 | A1 | 8/2004 | Gueret |
| 2005/0022835 | A1 | 2/2005 | Ramet |

FOREIGN PATENT DOCUMENTS

| | | | |
|---|---|---|---|
| EP | 1 169 941 | A1 | 1/2002 |
| EP | 1 342 428 | A1 | 9/2003 |
| EP | 1 358 816 | A2 | 11/2003 |
| FR | 2 796 527 | | 1/2001 |
| FR | 2 856 560 | | 12/2004 |
| JP | 55-81809 | | 6/1980 |
| WO | WO 02/03832 | A1 | 1/2002 |

OTHER PUBLICATIONS

English language translation of JP 55-81809, dated Jun. 20, 1980.
U.S. Appl. No. 60/363,090, filed Mar. 12, 2002, 23 pages.

* cited by examiner

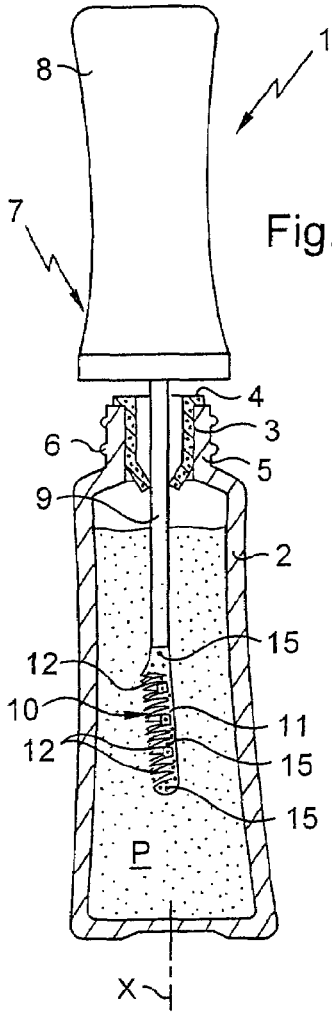
Fig.1
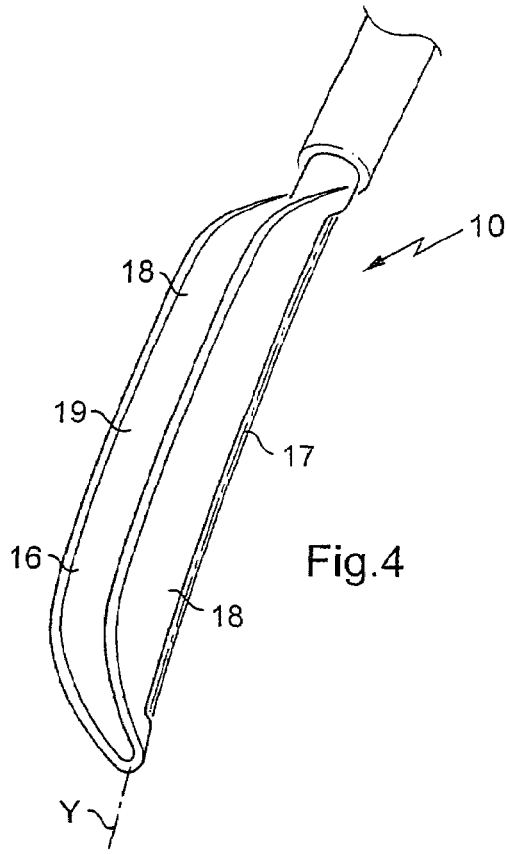
Fig.4
Fig.2
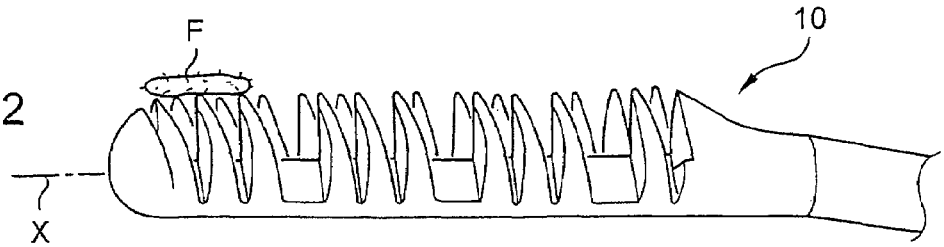
Fig.3
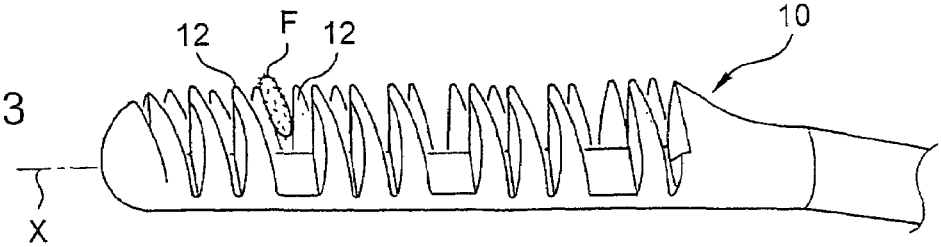

APPLICATOR DEVICE FOR APPLYING A SUBSTANCE

This application claims the benefit of priority of U.S. Provisional Application No. 60/577,169, filed Jun. 7, 2004, the contents of which are incorporated herein by reference. This application also claims the benefit of priority under 35 U.S.C. § 119 to French Patent Application No. 04 51024, filed May 25, 2004.

The present invention relates to applicator devices for applying products, including, for example, cosmetics and care products, onto keratinous fibers, such as, for example, hair, eyelashes, nails and/or eyebrows. For example, the invention relates to applying mascara to eyelashes.

In at least some examples, the devices may be used to apply cosmetic products, care products, make-up products, and/or products such as those defined in Counsel Directive 93/35/EEC (European Economic Community) dated Jun. 14, 1993, modifying EEC Directive 76/768, which provides one non-limiting, exemplary definition of cosmetic products. (Other definitions are also possible.) Cosmetic products may include, for example, makeup for the skin, hair, and/or nails, and care products include, for example, those products intended to be applied to the human and/or animal body to treat and/or prevent a pathological condition.

Patent application EP 1 129 640 discloses a packaging and applicator device including a wiper member constituted by a block of foam incorporating magnetic particles.

International application WO 02/03832 discloses a device that includes an applicator brush for applying mascara, wherein the brush has a twisted core and includes bristles containing at least one magnetized or magnetizable body.

Applications EP 1 169 941 and EP 1 342 428 disclose combs for the eyelashes or the eyebrows that include magnetic particles.

There may exist a need to create new conditions for applying a substance, such as, for example, a makeup or a care product, and where appropriate, to create new effects, such as new make up effects.

A need also may exist to wipe substance from an applicator in some other way while it is being removed from the receptacle containing the substance to be applied.

A need also may exist to generate interactions between the substance to be applied and the receptacle in which it is contained.

The invention may seek to satisfy at least one of the above-mentioned needs. Although the present invention may obviate one or more of the above-mentioned needs, it should be understood that some aspects of the invention might not necessarily obviate the above-mentioned needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one exemplary aspect, as embodied and broadly described herein, the invention includes a device for applying a substance. The device may comprise a receptacle configured to contain the substance and an applicator comprising an application member that is configured to be inserted into the receptacle so as to become loaded with the substance. The device may further comprise a magnetizable or magnetic wiper member disposed so as to permit the application member to pass therethrough while the application member is being removed from the receptacle. The wiper member may be made of a material that is substantially impermeable to the substance. In an exemplary aspect, the wiper member may not have cells.

In another exemplary embodiment, the material of the wiper member may be a material other than a foam having open or half-open cells. Thus, the material of the wiper member may be non-porous and may be configured so as not to become filled in depth with (e.g., absorb) the substance.

Making the wiper member out of a material that is substantially impermeable to the substance, such as, for example, from a material that does not have cells, may make it possible, for example, to incorporate a relatively high proportion of magnetizable or magnetic particles in the wiper member. This may enable the application member to be subjected to a relatively high magnetic field if so desired.

The wiper member may have magnetic properties only after having been exposed to a magnetic field prior to or after the device has been assembled.

The wiper member may be magnetizable and the application member may be magnetic, or vice versa. Alternatively, the wiper member and the application member may be magnetizable or the wiper member and the applicator member may be magnetic.

The magnetic or magnetizable particles may comprise ferrites, rare earths, or black or yellow iron oxides, for example. The size of the magnetic particles may range from about 1 micrometer (μm) to about 1 millimeter (mm).

The application member may optionally be magnetizable or magnetic. If so, magnetic interactions between the wiper member and the application member, while the application member is going past the wiper member, may, if so desired, be utilized so as to improve the distribution of substance on the application member and/or to increase the quantity of substance present on the application member after it has been removed from the receptacle.

The substance may optionally be magnetic or magnetizable. When the substance is magnetic or magnetizable, the magnetic interactions between the wiper member and the substance can change the way in which the application member becomes loaded with substance, and/or the way in which the substance is applied, such as, for example, when the substance includes magnetic or magnetizable fibers.

The applicator may include an application member made in various ways and it may comprise a brush including magnetic or magnetizable bristles, for example. According to an exemplary aspect, the brush also may include a twisted wire core holding the brush bristles.

The application member may optionally include flocking, which may optionally be magnetic or magnetizable.

The applicator may comprise an application member in the form of a comb or a brush including a magnetic or magnetizable support, for example, a support including magnetic or magnetizable particles. In the case of a brush, the support may include at least one through hole in which a tuft of bristles is held. The bristles may optionally be magnetic or magnetizable. In the case of a comb, the applicator may include teeth configured to apply the substance onto the eyelashes or the eyebrows. The teeth may be made integrally as a single piece with the support. For example, the teeth and support may be formed by molding a thermoplastic material. The teeth and/or support may include magnetic or magnetizable particles that are dispersed in the molded material.

When both the application member and the substance are magnetic or magnetizable, the magnetic interactions between the substance and the application member may be utilized to improve the distribution of the substance on the applicator.

In an embodiment, the magnetic field generated by the wiper member may also have additional properties, such as bacteriostatic properties, for example.

The wiper member may be made, at least in part, out of at least one of a thermoplastic material; a thermosettable material; an elastomer material, for example, a thermoplastic elastomer; a catalysable resin; and/or a polyolefin, for example, polyethylene.

The wiper member may be made in various shapes. In an exemplary aspect, the wiper member may include a portion of substantially uniform inside cross-section over a fraction of its length, for example.

According to yet a further exemplary aspect, the device may include at least a portion that is molded out of plastics material, such as, for example, the wiper member, the receptacle body, and/or the applicator. The plastics material may comprise, for example, at least one of a thermoplastic material; a thermosettable material; an elastomer material, for example, a thermoplastic elastomer; and a catalysable resin.

In another exemplary embodiment, the magnetic or magnetizable particles may be dispersed in the molded portion made of plastics material. The plastics material may include magnetic particles lying in the range 1% to 90% by weight, and in particular in the range 3% to 80%, or even in the range 5% to 70%.

In an exemplary aspect, the application member may be molded integrally as a single piece with a stem, the stem being secured to a handle. In a variant, the application member may be welded, clamped, snap-fastened, bonded, or otherwise connected to a stem secured to a handle. The handle may constitute a closure cap for closing the receptacle containing the substance and may include internal threading configured to cooperate with external threading formed on a neck of the receptacle.

The stem may include a constriction that may be configured to prevent the wiper member from being mechanically stressed when the stem is in position in the receptacle while the application member is not in use.

As mentioned above, in an exemplary aspect, the substance may include magnetic or magnetizable particles. By way of example, the substance may include magnetic or magnetizable particles lying in the range from about 0.2% to about 50% by weight. This amount may be particularly suitable when the substance is a paste or a cream. The substance may also be a loose powder ln that case, the substance may include more than about 50% by weight of magnetic or magnetizable particles, or even substantially 100% of magnetic or magnetizable particles, where appropriate.

The term "particles" should not be understood in a limited sense, but rather can encompass particles of any form, including, but not limited to, for example, lamellar, spheroidal, and/or fiber particles. Thus, the magnetic or magnetizable particles may, at least in part, be magnetic or magnetizable fibers. When, the magnetic or magnetizable particles are contained in the substance, the particles may optionally be coated and/or colored. The particles may be incorporated with fibers made of plastics material, for example. In an exemplary aspect, the particles may be attractable in an optionally permanent manner.

By acting on the magnetic interactions between the particles, for example, fibers, and the application member and/or the wiper member, it may be possible to utilize the reactivity of the fibers to an external magnetic field, such as, for example, the alignment of the fibers with magnetic field lines. This may permit orientation of the fibers in a particular way, for example, while the application member is being loaded with substance, during wiping, and/or during application, with a view to increasing the quantity of substance on the application member, facilitating application, and/or improving the quality of the application, such as, for example, the make up quality, for example.

In an exemplary aspect, a magnetic field may be created between the wiper member and the application member, and the particles, e.g., fibers, in the substance may be aligned with said field.

When magnetic or magnetizable particles (e.g., fibers) are contained in the substance, the fact that they are magnetic or magnetizable may to some extent also enable the substance to be organized in the receptacle and/or on the surface to which the substance is applied.

The device may optionally be provided with a one-piece magnet. For example, the wiper member may comprise a one-piece magnet, for instance, instead of a plurality of magnetic or magnetizable particles.

In an embodiment, the applicator is at least partially removable from the receptacle during application of the substance to a surface. The wiper member may be configured so as to come into contact with the application member while the applicator is being removed from the receptacle. The wiper member may also be configured so as to enable the application member to pass through the wiper member without any contact between them.

Independently or in combination with the above, in an exemplary aspect, the invention may include a device for applying a substance onto the eyelashes or the eyebrows, the device comprising an applicator comprising a comb or a brush, the applicator including a non-metal support including magnetic or magnetizable particles. The device may further comprise a receptacle configured to contain the substance to be applied, and a wiper member through which the application member is configured to pass while it is being removed from the receptacle. The wiper member may include magnetic or magnetizable particles.

Independently or in combination with the above, an exemplary aspect of the invention may include a device for applying a substance comprising a receptacle configured to contain the substance and an applicator comprising an application member configured to be inserted into the receptacle so as to become loaded with substance from the receptacle and configured to be removable from the receptacle. The application member may comprise a comb, which, in an exemplary aspect, may be configured to apply the substance to eyelashes or eyebrows. The device may further comprise a magnetic or magnetizable wiper member disposed so as to permit the application member to pass therethrough while the application member is being removed from the receptacle.

Independently or in combination with the above, the invention also may include, in an exemplary aspect, a device for applying a substance. The device may comprise a receptacle configured to contain the substance, an application member configured to apply the substance, and a magnetic or magnetizable wiper member configured so as to enable the application member to pass therethrough without contact between the wiper member and the application member. The substance, in an exemplary embodiment, may have magnetic properties. According to an exemplary aspect, the receptacle of the device may contain the substance and the substance may be a cosmetic or care product. In an example the substance may be a make-up product.

Aside from the structural and procedural arrangements set forth above, the invention could include a number of other arrangements, such as those explained hereinafter. It is to be understood, that both the foregoing description and the following description are exemplary. The accompanying drawings are incorporated in and constitute a part of this specification. The drawings illustrate exemplary embodiments of the invention and, together with the description, serve to explain some principles of the invention. In the drawings, FIG. 1 is a a schematic longitudinal section view of an exemplary embodiment of an applicator device;

FIGS. 2 and 3 are partial schematic perspective views of the applicator of FIG. 1;

FIG. 4 is a partial schematic perspective view of another exemplary embodiment of an applicator;

Reference will now be made in detail to some possible embodiments of the invention, examples of which are illustrated in the accompanying drawings. Wherever possible, the same reference numbers are used in the drawings and the description to refer to the same or like parts.

Figure 5:
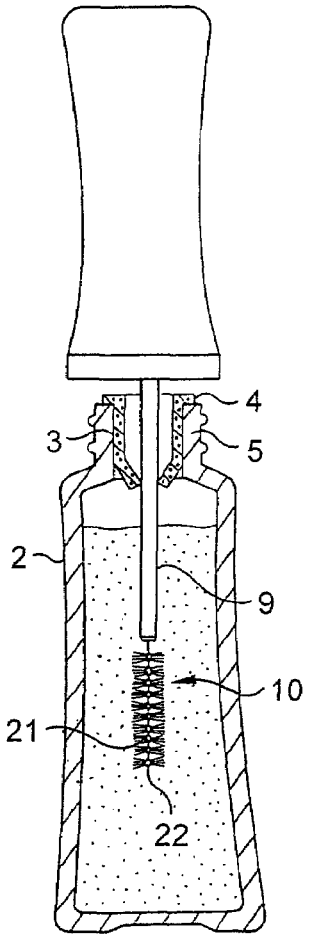
FIGS. 5 to 7 are schematic longitudinal section views of other exemplary embodiments of applicator devices.

FIG. 1 shows a device 1 for applying a substance P, such as a cosmetic (e.g., make up product) and/or a care product. For example, the device 1 may be for applying mascara. The device 1 comprises a receptacle 2 containing the substance P, a wiper member 3, and an applicator 7.

The applicator 7 further includes a closure cap 8 that also may constitute a handle. The closure cap 8 is connected by a stem 9 to an application member 10 of longitudinal axis X.

The closure cap 8 may include internal threading, not shown in FIG. 1, which may be configured to cooperate with corresponding threading 6 on the neck 5 of the receptacle 2. The threadings may cooperate to close the receptacle 2 in leaktight manner via the closure cap 8.

In the embodiment of FIG. 1, the wiper member 3 is made with a collar 4 which comes to bear axially against the neck 5 receptacle 2.

The wiper member 3 may be made by molding a material, such as, for example, a thermoplastic material, and, in the embodiment of FIG. 1, magnetic or magnetizable particles 15 may be dispersed in the material forming the wiper member 3.

The wiper member 3 can optionally come into contact with the stem 9 when the device is closed by the closure cap 8. By way of example, the stem 9 can include a constriction (e.g., area of reduce cross-section) (not shown). The constriction may be configured such that the wiper member 3 is not deformed while the receptacle is closed by the applicator closure cap 8.

In the embodiment shown in FIGS. 1-3, the application member 10 is formed by a comb that comprises a support 11 and teeth 12. The teeth 12 and support 11 may be made integrally as a single piece by molding a material, such as, for example, by injection molding.

The support 11 may include magnetic or magnetizable particles 15 that are dispersed in the material forming the support 11. When the teeth 12 are made integrally as a single piece with the support 11, they also may include magnetic or magnetizable particles 15. However, it is not beyond the ambit of the present invention for the teeth 12 not to be made integrally as a single piece with the support 11. In that case, the teeth 12, formed separately from the support 11 may not include any magnetic or magnetizable particles.

By way of example, the plastics materials used to manufacture all or part of the device, such as, for example, the application member 10 and/or the wiper member 3, may be selected from a thermoplastic material; a thermosettable material; an elastomer material, for example, a thermoplastic elastomer; and a catalysable resin.

The plastics material may include magnetic or magnetizable particles ranging from about 1% to about 90% by weight, for example, ranging from about 3% to about 80% by weight and/or ranging from about 5% to about 70% by weight.

By way of example, the magnetic or magnetizable particles may be made of ferrites, rare earths, and more generally any natural or synthetic particles having magnetic properties, for example, tinned iron particles, or black or yellow iron oxide particles.

The particles may be coated in an exemplary aspect. For example, the particles may comprise an optionally magnetic core, surrounded by an optionally magnetic coating. The particles can be of any shape, and can have an average size ranging from about 1 μm to about 1 mm, for example. By way of example, the particles can be tinned iron particles encapsulated in a colored coating.

The use of particles including tinned iron may be used, for example, when it is desirable for the particles to lose their magnetization relatively quickly, whereas the magnetism of ferrites may be longer lasting.

In the exemplary embodiment of FIG. 1, the stem 9 does not include magnetic or magnetizable particles, but it is not beyond the ambit of the present invention for the stem 9 also to contain magnetic or magnetizable particles.

The application member 10 can be molded integrally as a single piece with the stem 9, or it can be connected to the stem, such as by fastening it thereon by adhesive, welding, or snap-fastening, for example.

The substance P can include magnetic or magnetizable particles ranging from about 0.2% to about 50% by weight, for example, when the substance is a cream or a paste. In the case of a loose powder, the proportion of particles may be greater, and may reach substantially 100%.

FIGS. 2 and 3 show the application member 10 and a magnetic or magnetizable fiber F coming from the substance P loaded onto the application member 10. As shown in the exemplary embodiment of FIG. 2, the fiber F is oriented substantially parallel to the axis X of the application member 10. In the exemplary embodiment of FIG. 3, the magnetic fiber F is oriented substantially perpendicularly to the axis X and substantially parallel to the longitudinal axis of the teeth 12.

Such a difference in the orientation of the fiber F relative to the application member 10 may result from the fact that the teeth 12 of the application member 10 in FIGS. 2 and 3 include particles 15 that have been magnetized with different respective orientations, in particular with respective orientations that are perpendicular to each other.

It should be understood that depending on the orientation of the fibers on the application member 10, as shown for example in FIGS. 2 and 3, the behavior of the substance while passing through the wiper member, and while being applied, could be different. The fibers used can contain about 40% of ferrites, for example, and may contain less than 60% of ferrites in an exemplary aspect so as to conserve their flexibility. The fibers can be made of a polyamide, e.g. Nylon®, polyethylene terephthalate (PET), polyethylene (PE), polypropylene (PP), or Pebax®.

The fibers can be water-absorbent, for example. Examples of such fibers have been described in US patent application publication 2002/0182409 A1, the content of which is incorporated herein by reference.

It should be understood that the orientations of the fibers shown in FIGS. 2 and 3 are exemplary only and other orientations may be achieved. Moreover, the fibers F of FIGS. 2 and 3 are exemplary forms of particles that may be used in the substance P and other forms of particles are considered within the scope of the invention.

It is not beyond the ambit of the present invention for the above-described application member 10 to be a comb as described in any of the following: U.S. Pat. Nos. 6,581,610, 6,412,496, 5,539,950, 6,343,607, 6,866,046, 6,814,084, 6,675,814, 6,446,637, 6,546,937, and 6,655,390, U.S. patent application publication 2003/0213498 A1, and in French patent applications FR 03 07921 and FR 03 07922, the entire disclosure of each of those patents and applications being incorporated herein by reference.

In some embodiments, the application member 10 is in the form of a comb. However, it should be understood that it is within the scope of the invention for the application member 10 to have a different configuration than that shown in FIGS. 1-3.

By way of example, as illustrated in FIG. 4, the application member 10 can comprise at least two walls 18 forming a cavity 16 therebetween that is capable of retaining substance. At least one slot 17 may extend along a longitudinal axis Y at the bottom of the cavity 16 through which substance retained in the cavity 16 may be able to be dispensed through in order to be applied. The application member 10 also may include at least one opening 19 via which the cavity 16 opens out to the outside. The opening 19 may be substantially opposite the slot 17 and may present at least one portion having, in a plane that is transverse to length of the slot 17 (e.g., perpendicular to the axis Y), a width that is greater than the width of the slot 17 in the same plane, as shown in FIG. 4.

One example of such an applicator is described in US patent application publication 2004/0161285 A1, the entire disclosure of which is incorporated herein by reference.

The application member 10 can also be formed by a brush comprising bristles 21 that are held between the branches of a core 22 formed from a wire that is folded into a U-shape and twisted, as shown in FIG. 5, for example.

In an exemplary aspect, the core 22 may be magnetized or magnetizable and/or the bristles 21 may contain magnetic or magnetizable particles (e.g., magnetic or magnetizable particles).

The core 22 may optionally be rectilinear, and the bristles 21 may all have the same length or differing lengths, so as to impart differing shapes to the brush of FIG. 5. Examples of such brushes are described in U.S. patent application publications 2004/0134507 A1, 2003/0178043 A1, 2002/01939385 A1, and 2002/0124860 A1, U.S. provisional patent application 60/363,090, and U.S. Pat. No. 6,662,810, the contents of those applications and said patent being incorporated herein by reference.

Figure 6:
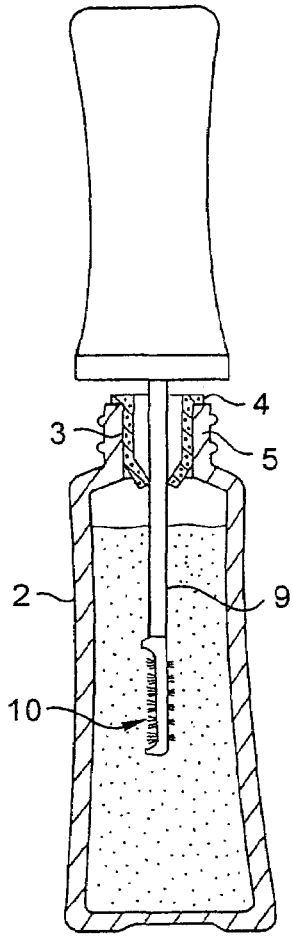

In another exemplary embodiment, the application member 10 may comprise a brush having a core that is not twisted, as shown in FIG. 6. In this embodiment, the non-metal support 11 includes at least one through hole in which a tuft of bristles is held, as described in US patent application publication 2002/011251 A1, the entire disclosure of which is incorporated herein by reference.

Figure 7:
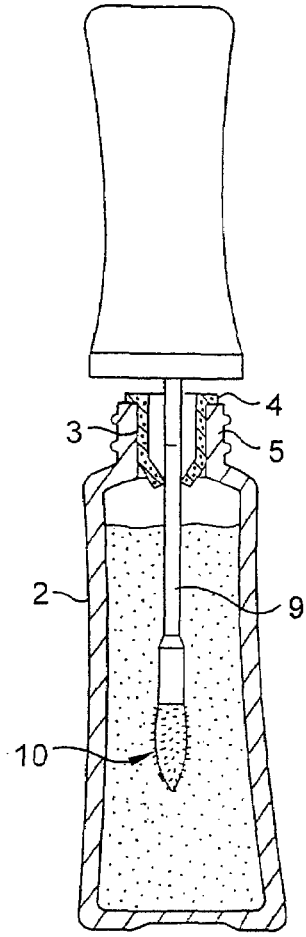

In yet another exemplary embodiment, the application member 10 can include at least one flocked portion, as shown in FIG. 7, for example. Such an application member 10 may, for example, be used as a device for applying substance to the lips, e.g. lipstick, to the eyelids, e.g. eyeshadow, or to outline the eyes, e.g., eyeliner. The application member 10 can also include, in another exemplary aspect, a paint brush, e.g. for applying a substance to the nails and/or for applying a blusher, or can include a portion made of foam or of felt.

The wiper member 3 can optionally come into contact with the stem 9 and/or the application member 10 while the application member 10 is being removed from the receptacle 2.

Figure 8:
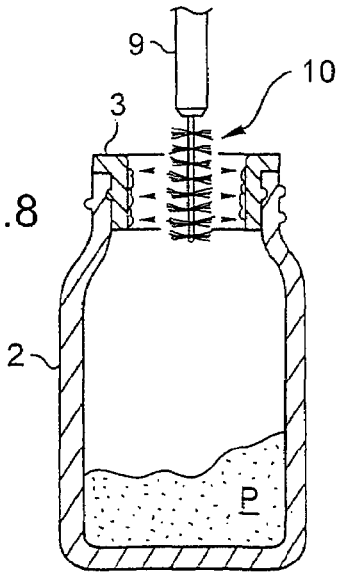
FIG. 8 is a schematic partial longitudinal section view of another exemplary embodiment of an applicator device.

In the exemplary embodiment of FIG. 8, the wiper member 3 does not come into contact with the application member 10 since the inside diameter of the wiper member 3 is greater than the outside diameter of the application member 10.

The substance P in FIG. 8 may be magnetic or magnetizable. In this case, the substance P that is loaded onto the application member 10 may be attracted by the wiper member 3 and deposited thereon. Thus, the wiper member 3 may make it possible to control the amount of substance that is loaded on the applicator member 10 as it is withdrawn from the receptacle 2.

The application member 10 also optionally may have magnetic properties.

The wiper member 3 can include a one-piece magnet that is, for example, manufactured by sintering rare earths. Alternatively, the wiper member 3 may include magnetic particles dispersed in a material, such as a resin, for example, used to form the wiper member 3.

According to an exemplary aspect, the wiper member 3 can be rigid.

Figure 9:
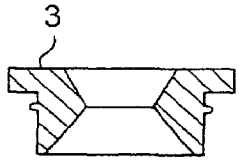
FIGS. 9 and 10 are axial section views showing exemplary embodiments of a wiper member.
Figure 10:
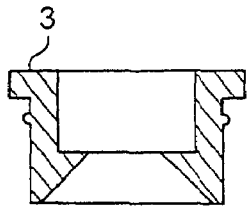

Further, the wiper member 3 may be made with various profiles, as shown, for example, in FIGS. 9 and 10. The profile of the wiper member 3 may be selected based on the shape desired for the magnetic field lines.

It is not beyond the ambit of the present invention for the wiper member 3 to be made with a slot rather than a circular-shaped passage for the applicator member, or with any other cross-sectional shaped opening to allow the applicator to pass therethrough.

Where appropriate, the wiper member can be flocked with the flocking, and the flocking may optionally have magnetic properties.

Throughout the description, including in the claims, the term "a" should be understood as being synonymous with "at least one" (i.e., relating to both the singular and the plural) unless otherwise specified to the contrary Sizes and shapes of various structural parts and materials used to make the above-mentioned parts are illustrative and exemplary only, and one of ordinary skill in the art would recognize that these sizes, shapes, and materials can be changed to produce different effects and/or characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a substance, the device comprising:

a receptacle configured to contain the substance;

an applicator comprising an application member configured to be inserted into the receptacle so as to become loaded with substance from the receptacle and configured to be removable from the receptacle; and a magnetizable or magnetic wiper member disposed so as to permit the application member to pass therethrough while the application member is being removed from the receptacle, wherein the wiper member is made of a material that is substantially impermeable to the substance, wherein the device further comprises magnetic or magnetizable particles, and wherein the particles have an average size ranging about 1 μm to about 1 mm.

2. The device of claim 1, wherein the application member is magnetic or magnetizable.

3. The device of claim 1, wherein the application member comprises a brush.

4. The device of claim 3, wherein the brush comprises magnetic or magnetizable bristles.

5. The device of claim 1, wherein the application member comprises a brush comprising a twisted core.

6. The device of claim 1, wherein the application member comprises flocking.

7. The device of claim 6, wherein the flocking is magnetizable or magnetic.

8. The device of claim 1, wherein the wiper member is made at least partially from a material chosen from a thermoplastic material; a thermosettable material; an elastomer material, a thermoplastic elastomer; a catalysable resin; a polyolefin; and polyethylene.

9. The device of claim 1, wherein the wiper member comprises a portion having a uniform inside cross-section over at least part of its length.

10. The device of claim 1, wherein the particles comprise a material chosen from at least one of ferrites; rare earths; iron oxides; black or yellow iron oxides; and tinned iron particles.

11. The device of claim 1, wherein at least a portion of the device is molded out of a plastics material.

12. The device of claim 11, wherein the plastics material comprises at least one of a thermoplastic material; a thermosettable material; an elastomer material; a thermoplastic elastomer; and a catalysable resin.

13. The device of claim 11, wherein the plastics material comprises magnetic particles ranging from about 1% to about 90% by weight.

14. The device of claim 11, wherein the plastics material comprises magnetic particles ranging from about 3% to about 80% by weight.

15. The device of claim 11, wherein the plastics material comprises magnetic particles ranging from about 5% to about 70% by weight.

16. The device of claim 1, wherein the application member is fastened to a stem that is secured to a handle.

17. The device of claim 1, further comprising a closure cap configured to close the receptacle.

18. The device of claim 1, further comprising the substance contained in the receptacle.

19. The device of claim 18, wherein the substance is a cosmetic or care product.

20. The device of claim 19, wherein the substance is a make up product.

21. The device of claim 18, wherein the substance comprises magnetic or magnetizable particles.

22. The device of claim 21, wherein the substance comprises magnetic or magnetizable particles in an amount of more than about 50% by weight.

23. The device of claim 22, wherein the substance comprises a loose powder.

24. The device of claim 21, wherein the particles of the substance comprise fibers.

25. The device of claim 1, wherein the wiper member is configured so as to come into contact with the application member while the application member is being removed from the receptacle.

26. The device of claim 1, wherein the wiper member is configured so as to enable the application member to pass through the wiper member without contacting the wiper member.

27. The device of claim 26, wherein the wiper member comprises a one-piece magnet.

28. The device of claim 1, wherein the wiper member is magnetizable and the application member is magnetic.

29. The device of claim 1, wherein each of the wiper member and the application member is either magnetic or magnetizable.

30. The device of claim 1, wherein the wiper member does not comprise open cells or partially open cells.

31. The device of claim 1, wherein the wiper member is nonporous.

32. The device of claim 1, wherein the wiper member is configured such that it does not absorb the substance.

33. A device for applying a substance, the device comprising:

a receptacle configured to contain the substance:

an applicator comprising an application member configured to be inserted into the receptacle so as to become loaded with substance from the receptacle and configured to be removable from the receptacle; and a magnetizable or magnetic wiper member disposed so as to permit the application member to pass therethrough while the application member is being removed from the receptacle, wherein the wiper member is made of a material that is substantially impermeable to the substance, and wherein the application member comprises a support comprising magnetic particles.

34. The device of claim 33, wherein the application member comprises a comb or a brush.

35. The device of claim 34, wherein the application member comprises a brush comprising magnetizable or magnetic bristles.

36. The device of claim 34, wherein the application member comprises a comb having teeth configured to apply the substance onto eyelashes or eyebrows.

37. The device of claim 36, wherein the teeth are made integrally as a single piece with the support.

38. The device of claim 36, wherein the teeth are molded with the support.

39. The device of claim 33, wherein the support comprises at least one through hole configured to hold a tuft of bristles.

40. A device for applying a substance, the device comprising:

a receptacle configured to contain the substance:

an applicator comprising an application member configured to be inserted into the receptacle so as to become loaded with substance from the receptacle and configured to be removable from the receptacle; and a magnetizable or magnetic wiper member disposed so as to permit the application member to pass therethrough while the application member is being removed from the receptacle, wherein the wiper member is made of a material that is substantially impermeable to the substance, and wherein the applicator further comprises a stem and the application member is molded integrally as a single piece with a stem.

41. The device of claim 40, further comprising magnetic or magnetizable particles.

42. The device of claim 41, wherein the particles have an average size ranging about 1 μm to about 1 mm.

43. The device of claim 40, further comprising a handle, wherein the stem is configured to be secured to the handle.

44. The device of claim 43, wherein the handle constitutes a closure cap configured to close the receptacle.

45. A device, for applying a substance, the device comprising:

a receptacle configured to contain the substance;

an applicator comprising an application member configured to be inserted into the receptacle so as to become loaded with substance from the receptacle and configured to be removable from the receptacle; and a magnetizable or magnetic wiper member disposed so as to permit the application member to pass therethrough while the application member is being removed from the receptacle, wherein the wiper member is made of a material that is substantially impermeable to the substance, wherein the device further comprises the substance contained in the receptacle, wherein the substance comprises magnetic or magnetizable particles, and wherein the substance comprises magnetic or magnetizable particles in amount ranging from about 0.2% to about 50% by weight.

46. The device of claim 45, wherein the substance comprises a paste or a cream.

47. A device for applying a substance, the device comprising:

a receptacle configured to contain the substance;

an applicator comprising an application member configured to be inserted into the receptacle so as to become loaded with substance from the receptacle and configured to be removable from the receptacle; and a magnetizable or magnetic wiper member disposed so as to permit the application member to pass therethrough while the application member is being removed from the receptacle, wherein the application member comprises a comb.

* * * * *